US007288010B2

(12) United States Patent
Kamio

(10) Patent No.: US 7,288,010 B2
(45) Date of Patent: Oct. 30, 2007

(54) PERSONAL WATERCRAFT

(75) Inventor: Kunihiko Kamio, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/453,271

(22) Filed: Jun. 13, 2006

(65) Prior Publication Data

US 2006/0286877 A1 Dec. 21, 2006

(30) Foreign Application Priority Data

Jun. 17, 2005 (JP) ..... 2005-177323

(51) Int. Cl.
*B63H 21/32* (2006.01)

(52) U.S. Cl. ..... 440/89 J

(58) Field of Classification Search ..... 440/89 R, 440/89 J, 89 B, 89 F
See application file for complete search history.

(56) References Cited

U.S. PATENT DOCUMENTS 5,234,364 A * 8/1993 Ito ..... 440/89 R
6,551,155 B2 * 4/2003 Lecours et al. ..... 440/89 R
7,140,935 B2 * 11/2006 Futaki ..... 440/89 F
2004/0166747 A1 * 8/2004 Matsuda et al. ..... 440/89 B

FOREIGN PATENT DOCUMENTS

JP 09-236015 9/1997
JP 2004-098966 4/2004

* cited by examiner

*Primary Examiner*—Ed Swinehart
(74) *Attorney, Agent, or Firm*—Alleman Hall McCoy Russell & Tuttle LLP

(57) ABSTRACT

A personal watercraft including a body including a hull and a deck covering the hull from above, an engine accommodated in an interior of the body, and an exhaust system that is accommodated in the interior of the body. The exhaust system includes an upstream muffler and a downstream muffler located on an upstream side and on a downstream side in a flow of the exhaust gas, the exhaust gas emitted from the engine flowing through the upstream and downstream mufflers, a first exhaust pipe through which the upstream and downstream mufflers communicate with each other, and a second exhaust pipe configured to extend from the downstream muffler outside the body. The upstream muffler and the downstream muffler are arranged in parallel, and the second exhaust pipe extends from the downstream muffler through a region that is located closer to the engine than the first exhaust pipe.

4 Claims, 6 Drawing Sheets

PERSONAL WATERCRAFT

TECHNICAL FIELD

The present invention relates to a personal watercraft equipped with an engine and an exhaust system mounted in an interior of a body of the watercraft. More particularly, the present invention relates to a personal watercraft equipped with an exhaust system including mufflers arranged on right and left sides of the body.

BACKGROUND ART

A jet-propulsion personal watercraft for use in leisure, sport, etc., is equipped with an engine in an interior of a body including a hull and a deck covering the hull from above. An exhaust gas emitted from the engine is exhausted outside the body, through an exhaust system that is equipped behind the engine in the interior of the body and is configured to reduce the energy of the exhaust gas. As disclosed in Japanese Laid-Open Patent Application Publication No. 2004-98966 (in particular FIG. 3) and Japanese Laid-Open Patent Application Publication No. Hei. 9-236015, some personal watercraft include two mufflers arranged on right and left sides to accommodate an exhaust system in a limited inner space of a relatively small body.

In the exhaust system disclosed in Japanese Laid-Open Patent Application Publication No. 2004-98966, cylindrical mufflers each having closed both ends are positioned on an upstream side and on a downstream side in a flow of an exhaust gas and are arranged on right and left sides of the body. The exhaust gas emitted from an engine flows into the upstream muffler and then into a front portion of the downstream muffler through a first exhaust pipe extending from a rear portion of the upstream muffler. Further, the exhaust gas is discharged outside the body through a second exhaust pipe extending from a rear portion of the downstream muffler and through a region behind the first exhaust pipe. Thus, the exhaust system including the upstream muffler and the downstream muffler is efficiently disposed in the limited inner space of the body. In addition, the exhaust gas is repeatedly expanded and contracted while flowing through the upstream muffler, the first exhaust pipe, the downstream muffler, and the second exhaust pipe, in this order. As a result, the energy of the exhaust gas is efficiently reduced.

The center of gravity of a personal watercraft is a factor in determining a running characteristic of the personal watercraft, and therefore flexibility in positioning of the center of gravity is desirable. Because the center of gravity of the personal watercraft is substantially affected by the location of the engine, which is the component having the largest weight, there is a need for flexibility in the placement of the engine. Personal watercraft are typically equipped with an article accommodating compartment in a front part of the body. The engine is desirably positioned rearward rather than forward to increase a volume of the article accommodating portion.

SUMMARY OF THE INVENTION

The present invention addresses the above described conditions, and an object of the present invention is to provide a personal watercraft that is able to configure an exhaust system compactly by devising arrangement of components of the exhaust system, and is able to position an engine more flexibly.

According to the present invention, there is provided a personal watercraft comprising a body including a hull and a deck covering the hull from above, an engine accommodated in an interior of the body; and an exhaust system that is accommodated in the interior of the body and is configured to guide an exhaust gas emitted from the engine outside the body; wherein the exhaust system includes an upstream muffler and a downstream muffler located on an upstream side and on a downstream side in a flow of the exhaust gas, the exhaust gas emitted from the engine flowing through the upstream and downstream mufflers; a first exhaust pipe through which the upstream and downstream mufflers communicate with each other; and a second exhaust pipe configured to extend from the downstream muffler outside the body; and wherein the upstream muffler and the downstream muffler are arranged in parallel, and the second exhaust pipe extends from the downstream muffler through a region which is located closer to the engine than the first exhaust pipe.

Conventionally, the second exhaust pipe extends to be more distant from the engine than the first exhaust pipe. In contrast, in the exhaust system of the present invention, the upstream muffler and the downstream muffler are arranged in parallel, and the second exhaust pipe extends to be closer to the engine than the first exhaust pipe. Thereby, the exhaust system is compactly configured. As a result, sufficient space is provided to enable flexibility in positioning of the engine.

The exhaust system may be disposed behind the engine. The first exhaust pipe may be configured to couple a rear portion of the upstream muffler and a rear portion of the downstream muffler to each other, and the second exhaust pipe may extend from the downstream muffler at a location forward relative to a location where the first exhaust pipe is coupled to the downstream muffler. Thereby, the upstream muffler and the downstream muffler can be placed substantially at the same position in the longitudinal direction of the body of the watercraft. As a result, the exhaust system can be compactly configured, and the longitudinal dimension of the body can be made smaller.

The personal watercraft may further comprise a water jet pump that is disposed behind the engine and is configured to be driven by the engine. The water jet pump may be mounted between the upstream muffler and the downstream muffler, and the first exhaust pipe and the second exhaust pipe extend upward and are then curved above the water jet pump to extend downward. In such a configuration, the upstream muffler and the downstream muffler, each of which has a large volume, are mounted to efficiently utilize an inner space of the body. In addition, the shape of the first exhaust pipe and the second exhaust pipe makes it possible to inhibit water from flowing into the engine when the watercraft is inverted.

The hull may have a pump room for accommodating the water jet pump, the pump room being formed in a bottom surface of a center region in a width direction of the body at a rear end portion of the hull. The first exhaust pipe and the second exhaust pipe may extend through a region forward of the pump room. In such a configuration, since the first exhaust pipe and the second exhaust pipe are mounted to extend in a relatively wide space forward of the pump room, they can be easily assembled and disassembled, and the exhaust pipes can be simply configured.

The deck may include a flat rear deck provided at a rear portion thereof, and a protruding portion that is configured to protrude upward from the rear deck and to have an upper portion over which a straddle-type seat straddled by a rider is mounted. The first exhaust pipe and the second exhaust pipe may extend through an inner space of the protruding portion. In such a configuration, the first exhaust pipe and the second exhaust pipe can be easily assembled and disassembled. Because of the compact configuration of the exhaust system, the first exhaust pipe and the second exhaust pipe can be positioned relatively forward on the watercraft. In that case, the area of the flat rear deck is able to be increased.

The above and further objects and features of the invention will more fully be apparent from the detailed description with accompanying drawings.

DETAILED DESCRIPTION OF THE PREFERRED EMBODIMENTS

Figure 1:
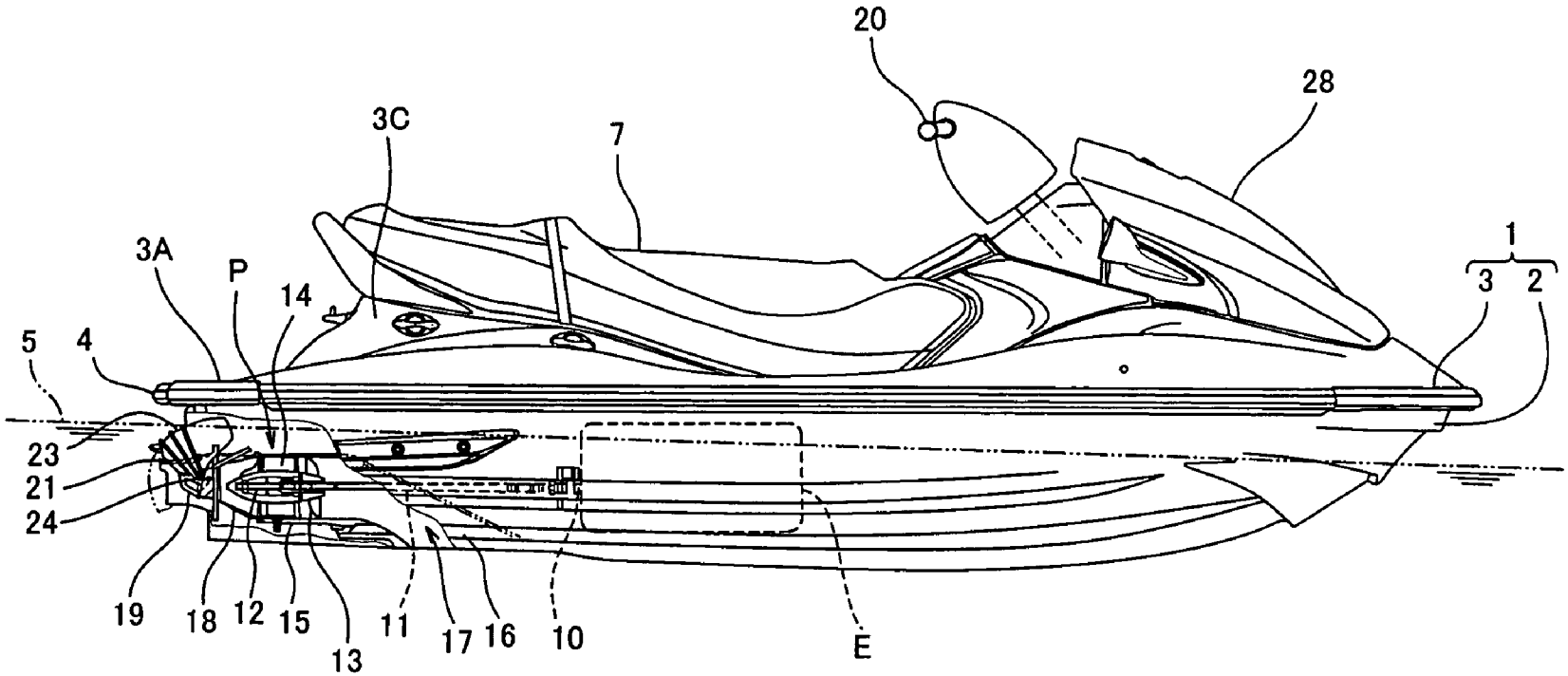
FIG. 1 is a side view showing an entire construction of a straddle-type personal watercraft according to an embodiment of the present invention.
Figure 2:
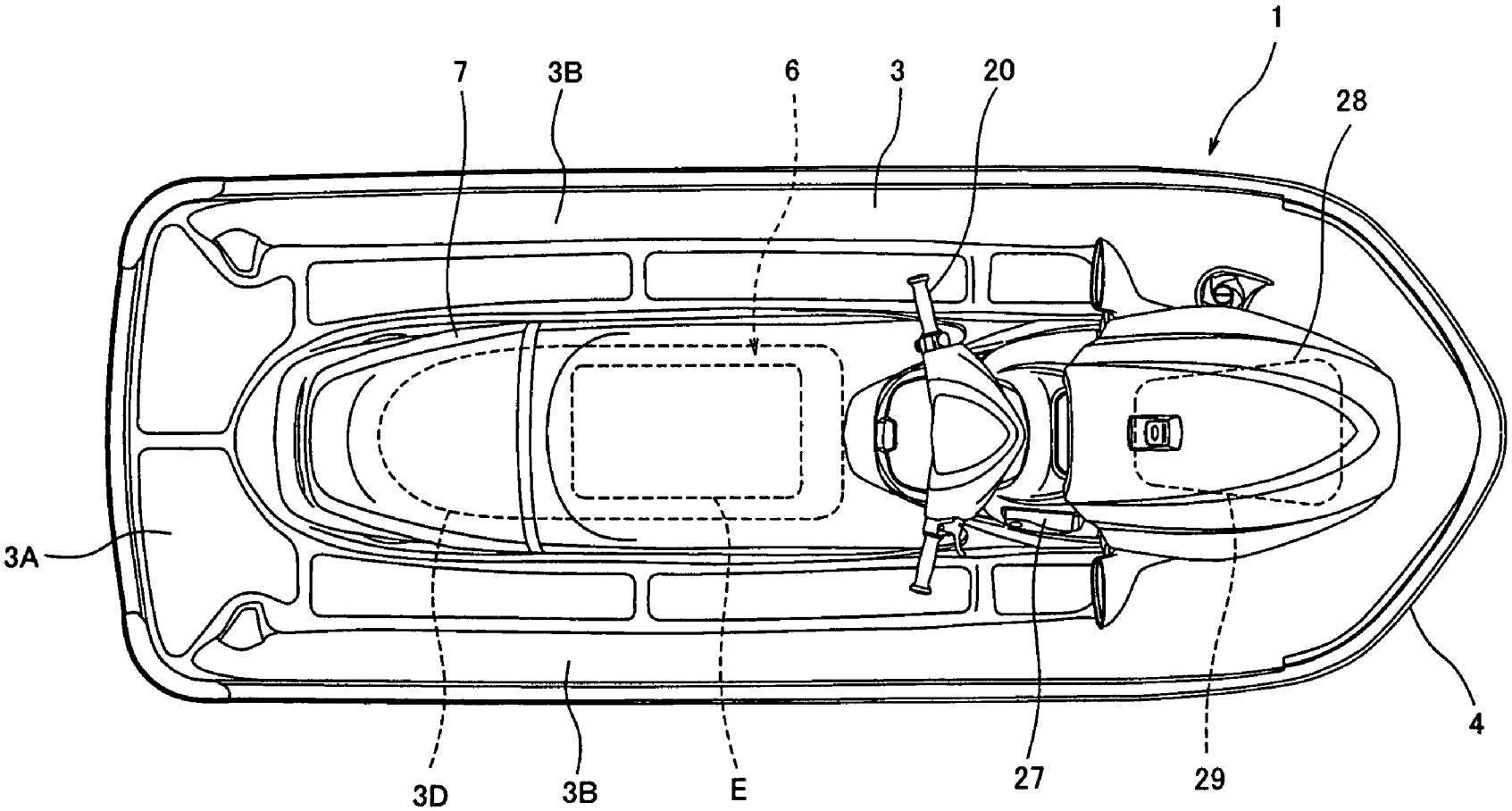
FIG. 2 is a plan view of the personal watercraft of FIG. 1.

Hereinafter, an embodiment of the present invention will be described with reference to the accompanying drawings. FIG. 1 is a side view showing an entire construction of a straddle-type personal watercraft according to an embodiment of the present invention. FIG. 2 is a plan view of the personal watercraft of FIG. 1. Turning now to FIGS. 1 and 2, a personal watercraft according to the embodiment has a body 1 including a hull 2 and a deck 3 covering the hull 2 from above. The hull 2 and the deck 3 are joined to each other over an entire periphery thereof by a gunnel line 4. In this embodiment, the gunnel line 4 is located above a waterline L (indicated by a two-dotted line in FIG. 1) of the watercraft being at rest in the water and is substantially parallel to the waterline L.

A rear deck 3A having a flat upper surface is formed at a rear portion of the deck 3. Foot decks 3B are located on right and left sides of the deck 3 to extend forward from the rear deck 3A. The foot decks 3B have flat upper surfaces. A protruding portion 3C is formed at a center region in a width direction of the deck 3 and is located in front of the rear deck 3A. The protruding portion 3C is surrounded by the right and left foot decks 3B. The protruding portion 3C is configured to protrude upward from the rear deck 3A and the foot decks 3B. A deck opening 3D is formed on an upper region of the protruding portion 3C to allow the inside and outside of the body 1 to communicate with each other therethrough.

The deck opening 3D, which has a substantially rectangular shape as seen from above, is formed at a location slightly rearward relative to a center of the deck 3 and at a center region in a width direction of the body 1 and is configured to extend in a longitudinal direction of the body 1. A straddle seat 7 is removably mounted over the deck opening 3D. An engine room 6 is provided in a space defined by the hull 2 and the deck 3 below the seat 7. A four-cycle engine (hereinafter referred to as an engine) E is mounted within the engine room 6. As used herein, the directions, namely, forward, rearward, leftward, rightward, upward and downward correspond with the directions seen from the perspective of a rider (not shown) straddling the seat 7 to steer the watercraft, except as where otherwise specifically described or illustrated.

As shown in FIG. 1, the engine E is mounted such that a crankshaft 10 extends rearward along the longitudinal direction of the body 1. A rear end of the crankshaft 10 is integrally and rotatably coupled with a pump shaft 12 of a water jet pump P through a propeller shaft 11. An impeller 13 is attached on the pump shaft 12. The impeller 13 is covered with a cylindrical pump casing 15 on the outer periphery thereof.

A water intake 16 is provided on a bottom surface of the hull 2. The water outside the watercraft is sucked from the water intake 16 and is fed to the water jet pump P through a water passage 17. The water jet pump P pressurizes and accelerates the water by the impeller 13 and fairing vanes 14 guide water flow behind the impeller 13. The water is ejected through a pump nozzle 18 having a cross-sectional area of flow that is gradually reduced rearward, and then from an outlet port 19 provided at a rear end thereof. As the resulting reaction, the watercraft obtains a propulsion force.

As shown in FIGS. 1 and 2, a bar-type steering handle 20 is coupled, through a cable (not shown), to a steering nozzle 21 mounted behind the pump nozzle 18. The steering nozzle 21 is mounted to be pivotable rightward or leftward around a pivot shaft (not shown). The steering handle 20 operates in association with the steering nozzle 21. When the rider rotates the handle 20 clockwise or counterclockwise, the steering nozzle 21 is pivoted in the opposite direction to enable the personal watercraft to be steered in a desired direction.

As shown in FIG. 1, a bowl-shaped reverse deflector 23 is mounted to an upper region of a rear side of the steering nozzle 21 so as to be pivotable downward around a pivot shaft 24 horizontally mounted. As shown in FIGS. 1 and 2, a reverse lever 27 is attached near the handle 20, for example, at a location of the body 1 that is forward and rightward of the handle 20. The reverse lever 27 is configured to be operated to allow switching between forward movement and rearward movement of the watercraft. A hatch cover 28 is openably mounted to a front portion of the deck 3 that is located forward of the handle 20. An article accommodating compartment 29 having a predetermined volume is provided under the hatch cover 28.

Figure 3:
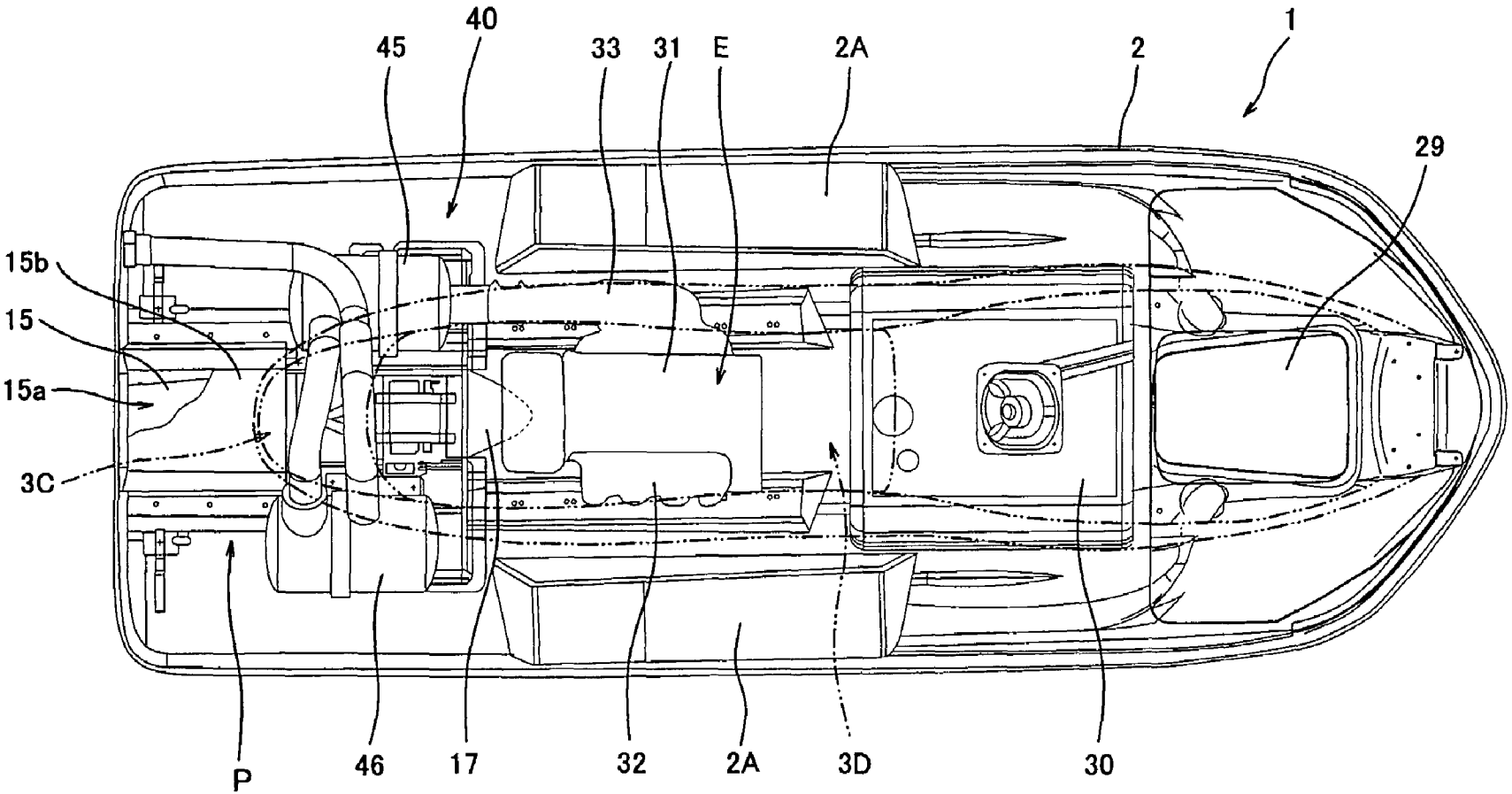
FIG. 3 is a plan view showing an internal construction of a body of the personal watercraft of FIG. 2, a deck of which is removed from the personal watercraft.

FIG. 3 is a plan view showing an internal construction of the body 1 of the personal watercraft, the deck 3 of which is removed from the personal watercraft of FIG. 2. Turning to FIG. 3, the protruding portion 3C and the deck opening 3D provided on the deck 3 are indicated by two-dotted line. As shown in FIG. 3, in the interior of the body 1, the article accommodating compartment 29, a fuel tank 30, the engine E, an exhaust system 40, and the water jet pump P are arranged in this order from forward. The article accommodating compartment 29 has a substantially rectangular shape in a plan view. The article accommodating compartment 29 is located at a front part in the interior of the body 1. The fuel tank 30 is disposed near and behind the article accommodating compartment 29 and below the handle 20 (FIG. 1). The fuel tank 30 has a substantially rectangular shape in a plan view.

Right and left support portions 2A are provided on right and left sides of the hull 2 and are located at a center region in the longitudinal direction of the body 1 to support the foot decks 3B of the deck 3 from below. The right and left support portions 2A have a rectangular shape that is elongated in the longitudinal direction of the body 1 in a plan view. In this embodiment, a longitudinal dimension of the support portions 2A is smaller than one third of the longitudinal dimension of the body 1. The support portions 2A have flat upper surfaces which are in contact with lower surfaces of the foot decks 3B, or are located in close proximity to, and under, the foot decks 3B with the hull 2 and the deck 3 joined to each other.

The engine E is disposed behind the fuel tank 30. The engine E is disposed between the right and left support portions 2A provided on the hull 2. The engine E includes an intake manifold 32 and an exhaust manifold 33 on a right side and a left side of an engine body 31, respectively. The exhaust manifold 33 is configured to allow the exhaust gas from the cylinders of the engine E to be gathered and to be guided rearward. The water jet pump P is disposed behind the engine E to extend in the longitudinal direction of the body 1. As shown in FIG. 3, a pump room 15*a*, which is formed by a pump cover portion 15*b* of the hull 2, is located at a rear portion of the water passage 17. The pump room 15*a* is configured to accommodate the water jet pump P having a pump casing 15 which has an inner space that is connected to the water passage 17. To be specific, the pump cover portion 15*b* is located in a center region in a width direction of a rear end portion of the hull 2. The pump cover portion 15*b* protrudes upward from the bottom surface of the hull 2, i.e., inward of the body 1 in a rear view. As a result, the pump room 15*a* protrudes upward from the bottom surface of the hull 2, i.e., inward of the body 1 in the rear view. The pump room 15*a* that accommodates the water jet pump P is formed inward, i.e., below the pump cover portion 15*b* to be connected to the water passage 17.

The exhaust system 40 is disposed behind the engine E. The exhaust system 40 is coupled to the exhaust manifold 33 of the engine E, and includes an upstream muffler 45, a downstream muffler 46, etc. The exhaust system 40 is configured to guide the exhaust gas emitted from the engine E while reducing the energy of the exhaust gas to discharge the exhaust gas outside the body 1 through a rear portion of the body 1.

Figure 4:
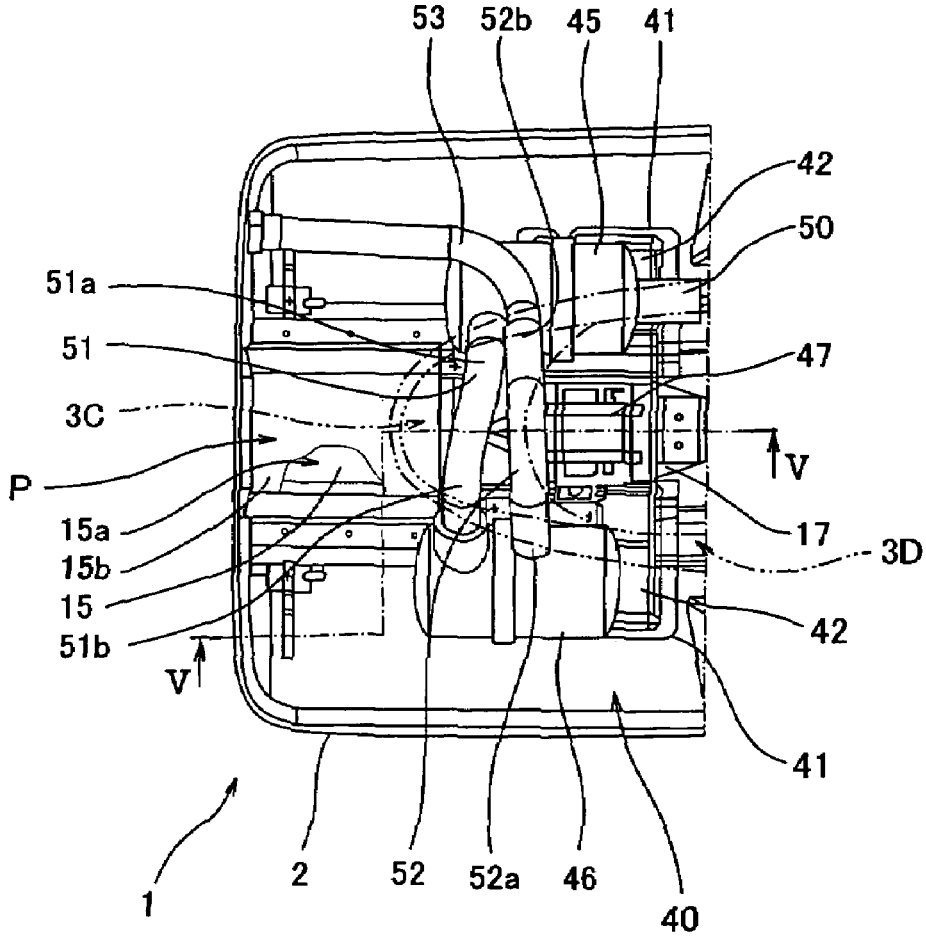
FIG. 4 is a partially enlarged plan view of a rear portion of the personal watercraft of FIG. 3, showing a construction of an exhaust system.
Figure 5:
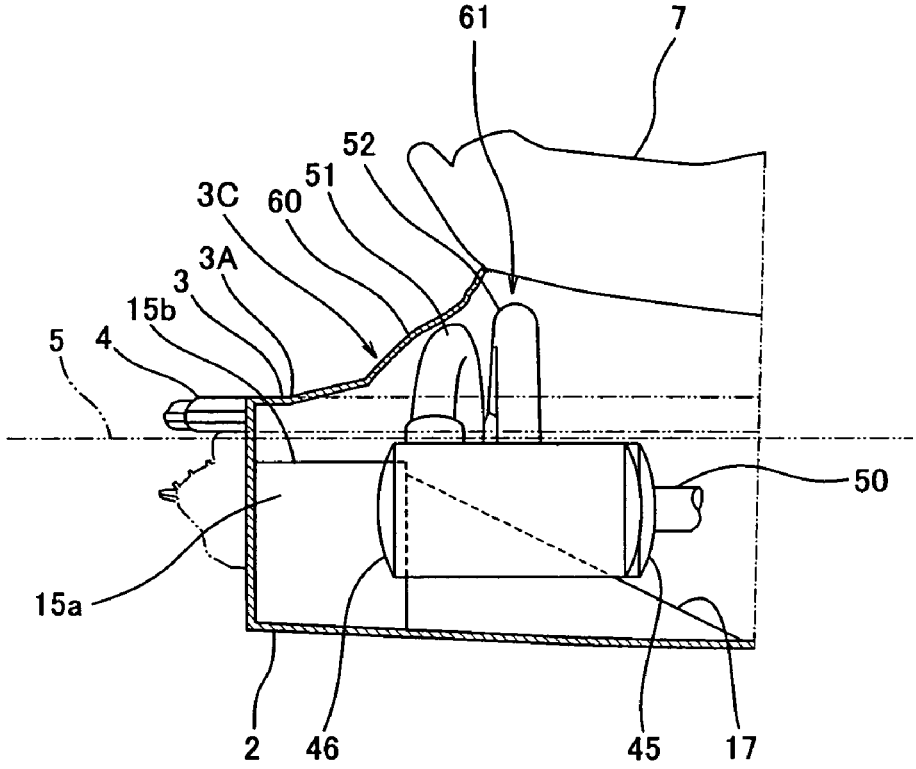
FIG. 5 is a partially enlarged side view of the body taken along line V-V of FIG. 4, a part of which is cut away, showing a construction of the exhaust system accommodated in an interior of the body.
Figure 6:
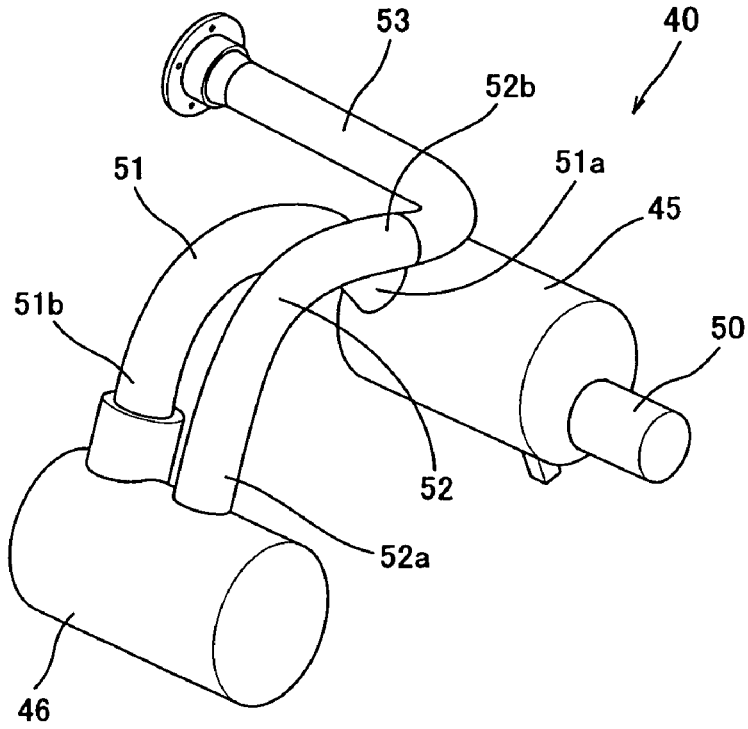
FIG. 6 is a perspective view of the exhaust system of FIG. 4.

FIG. 4 is a partially enlarged plan view of the exhaust system 40, showing a rear portion of the personal watercraft of FIG. 3. FIG. 5 is a partially enlarged side view of the body 1 taken along line V-V of FIG. 4, a part of which is cut away, showing a construction of the exhaust system 40 accommodated in the interior of the body 1. FIG. 6 is a perspective view of the exhaust system 40. In FIG. 4, the protruding portion 3C and the deck opening 3D are indicated by two-dotted lines. In FIG. 5, an outer shape of the body 1 is illustrated in simplified form.

As shown in FIG. 4, a muffler mounting base 41 is mounted in front of the pump casing 15 and is configured to cover the water passage 17. The muffler mounting base 41 has a rectangular shape that is elongated in plan view and is configured to extend to the right and to the left of the water passage 17. Right and left concave portions 42 that are recessed downward are formed on right and left regions of an upper portion of the muffler mounting base 41. The upstream muffler 45 is stably placed in the left concave portion 42 and the downstream muffler 46 is stably placed in the right concave portion 42. The upstream muffler 45 and the downstream muffler 46 are cylindrical and have closed end portions. The downstream muffler 46 is placed slightly behind the upstream muffler 45, i.e., more distant from the engine E than the upstream muffler 45. A battery 47 is placed on the muffler mounting base 41 between the upstream and downstream mufflers 45 and 46.

Since the upstream muffler 45 and the downstream muffler 46 are arranged as described above in this embodiment, the dimension of the exhaust system 40 in the longitudinal direction of the body 1 is made smaller. The arrangement of the upstream and downstream mufflers 45 and 46 is achieved by the configurations of a first exhaust pipe 51 and a second exhaust pipe 52 as described below.

A pipe 50 extends forward from a front portion of the upstream muffler 45, and a front end portion of the pipe 50 is coupled to a downstream end portion of the exhaust manifold 33 (see FIG. 3) of the engine E. A first exhaust pipe 51 is mounted in front of the pump room 15*a* to couple the upstream muffler 45 and the downstream muffler 46 to each other. An upstream end portion 51*a* of the first exhaust pipe 51 is coupled to a rear portion of the upstream muffler 45 and a downstream end portion 51*b* thereof is coupled to a rear portion of the downstream muffler 46.

The first exhaust pipe 51 is substantially inverted-U shaped to extend over the water jet pump P. To be specific, the first exhaust pipe 51 extends rightward and upward from a location corresponding to the upstream end portion 51*a* coupled to a peripheral wall of the rear portion of the upstream muffler 45 at a location slightly rightward relative to an uppermost portion of the upstream muffler 45, i.e., closer to the center in the width direction of the body 1, and then is curved above the water jet pump P to extend rightward and downward to a location corresponding to the downstream end portion 51*b* coupled to a peripheral wall of the rear portion of the downstream muffler 46 at a location slightly leftward relative to an uppermost portion of the downstream muffler 46, i.e., closer to the center in the width direction of the body 1.

A second exhaust pipe 52 extends from the downstream muffler 46 closer to the engine E than the first exhaust pipe 51 at a location that is forward relative to a location where the downstream end portion 51*b* of the first exhaust pipe 51 is coupled to the downstream muffler 46. The second exhaust pipe 52 extends to the left through a region that is located forward of the first exhaust pipe 51 and behind the battery 47 placed on the muffler mounting base 41.

The second exhaust pipe 52 is substantially inverted-U shaped to extend over the water jet pump P (see FIG. 6). To be specific, the second exhaust pipe 52 extends leftward and upward from a location corresponding to an upstream end portion 52*a* coupled to a peripheral wall of a center region in the longitudinal direction of the downstream muffler 46 at a location slightly leftward relative to the uppermost portion of the downstream muffler 46, and then is curved above the water jet pump P to extend leftward and downward to a location corresponding to a downstream end portion 52*b* that is configured to open in front of and near the upstream end portion 51*a*. A pipe 53 is coupled to the downstream end portion 52*b* of the second exhaust pipe 52. The pipe 53 is curved at a location above the rear portion of the upstream muffler 45 to extend rearward through an outward side of the upstream end portion 51*a* of the first exhaust pipe 51 and communicates with outside the body 1 at a rear wall (transom board) of the hull 2.

In the exhaust system 40 constructed above, the exhaust gas emitted from the engine E (see FIG. 3) flows into the upstream muffler 45 through the pipe 50, and then into the downstream muffler 46 through the first exhaust pipe 51. The exhaust gas outflows from the downstream muffler 46 and is thereafter discharged from the rear portion of the body 1 outside the body 1 through the second exhaust pipe 52 and the pipe 53.

In the personal watercraft of this embodiment, as shown in FIG. 5, the rear deck 3A is disposed near an upper surface of the pump cover portion 15*b*, and the protruding portion 3C is formed forward of the rear deck 3A. The protruding portion 3C has a tilted portion 60 extending forward and upward from a front portion of the rear deck 3A in a side view. As shown in FIG. 4, the tilted portion 60 has a dimension in the width direction of the body 1 that increases forward. So, an inner space 61 of the tilted portion 60 has a height and a width that increase forward.

As shown in FIG. 5, upper portions of the first exhaust pipe 51 and the second exhaust pipe 52 respectively extend through the inner space 61 of the tilted portion 60 of the protruding portion 3C. Because of the above mentioned structure of the inner space 61, the inverted-U shape of the second exhaust pipe 52 has a curvature larger than that of the inverted-U shape of the first exhaust pipe 51.

In the exhaust system 40 constructed above, since the first exhaust pipe 51 is mounted to extend between the rear portion of the upstream muffler 45 and the rear portion of the downstream muffler 46 and the second exhaust pipe 52 extends through the region that is located forward of the first exhaust pipe 51, i.e., closer to the engine E, the longitudinal dimension of exhaust system 40, including the upstream muffler 52, the downstream muffler 46, the first exhaust pipe 51, and the second exhaust pipe 52 is made smaller. Because of the compact configuration of the exhaust system 40, extra space in the interior of the body 1 is increased to enable the engine E to be positioned more flexibly. Since the engine E with a large weight is suitably placed, the center of gravity of the personal watercraft can be suitably located.

Because the first exhaust pipe 51 and the second exhaust pipe 52 extend through the inner space 61 of the tilted portion 60 of the protruding portion 3C of the deck 3, they are easily accessible through the deck opening 3D for the purposes of assembly and disassembly. If the exhaust system 40 compactly configured is positioned relatively forward on the watercraft, then the first and second exhaust pipes 51 and 52 can be correspondingly positioned relatively forward on the watercraft, and therefore become more easily accessible through the deck opening 3D. In this case, the protruding portion 3C of the deck 3 can be placed relatively forward on the watercraft, or the tilted portion 60 of the protruding portion 3C can be made to have a steep slope. As a result, the longitudinal dimension of the rear deck 3A located rearward of the protruding portion 3C can be increased.

If the exhaust system 40 compactly configured and the engine E are positioned relatively rearward on the watercraft, then a wide space is provided at the front part in the interior of the body 1. In that case, a volume of the article accommodating compartment 29 or a volume of the fuel tank 30 can be increased.

Furthermore, since the first and second exhaust pipes 51 and 52 are substantially inverted-U shaped in the exhaust system 40 of this embodiment, water is less likely to flow into the engine E through the exhaust system 40 even when the watercraft is inverted.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A personal watercraft comprising:

a body including a hull and a deck covering the hull from above;

an engine accommodated in an interior of the body; and an exhaust system that is accommodated in the interior of the body so as to be disposed behind the engine and is configured to guide an exhaust gas emitted from the engine outside the body;

wherein the exhaust system includes an upstream muffler and a downstream muffler located on an upstream side and on a downstream side in a flow of the exhaust gas, the exhaust system being configured to guide exhaust gas emitted from the engine flowing through the upstream and downstream mufflers, a pipe extending forward from a front portion of the upstream muffler and having a front end portion coupled to a downstream end portion of an exhaust manifold of the engine, a first exhaust pipe through which the upstream and downstream mufflers communicate with each other, and a second exhaust pipe configured to extend from the downstream muffler outside the body; and wherein the upstream muffler and the downstream muffler are arranged in parallel, the first exhaust pipe is configured to couple a rear portion of the upstream muffler and a rear portion of the downstream muffler to each other, and the second exhaust pipe extends toward a center in a lateral direction of the body from the downstream muffler at a location forward relative to a location where the first exhaust pipe is coupled to the downstream muffler, through a region that is located closer to the engine than the first exhaust pipe, and extends rearward through a region forward and lateral relative to a location where the first exhaust pipe is coupled to the upstream muffler.

2. The personal watercraft according to claim 1, further comprising:

a water jet pump that is disposed behind the engine and is configured to be driven by the engine;

wherein the water jet pump is mounted between the upstream muffler and the downstream muffler, and the first exhaust pipe and the second exhaust pipe extend upward and then are curved above the water jet pump to extend downward.

3. The personal watercraft according to claim 2, wherein the hull has a room for accommodating the water jet pump, the pump room being formed in a bottom surface of a center region in a width direction of the body at a rear end portion of the hull;

and wherein the first exhaust pipe and the second exhaust pipe extend through a region forward of the pump room.

4. The personal watercraft according to claim 1, wherein the deck includes a flat rear deck provided at a rear portion thereof, and a protruding portion that is configured to protrude upward from the rear deck and to have an upper portion over which a straddle-type seat straddled by a rider is mounted;

and wherein the first exhaust pipe and the second exhaust pipe extend through an inner space of the protruding portion.

* * * * *